US005082592A

United States Patent [19]

McDonald

[11] Patent Number: 5,082,592

[45] Date of Patent: Jan. 21, 1992

[54] CORROSION INHIBITORS FOR FERROUS METALS IN AQUEOUS SOLUTIONS COMPRISING A NONIONIC SURFACTANT AND AN ANIONIC OXYGEN CONTAINING GROUP

[75] Inventor: Alexander C. McDonald, The Woodlands, Tex.

[73] Assignee: Betz Laboratories, Inc., Trevose, Pa.

[21] Appl. No.: 547,556

[22] Filed: Jul. 2, 1990

Related U.S. Application Data

[63] Continuation-in-part of Ser. No. 346,095, May 2, 1989, abandoned.

[51] Int. Cl.[5] ..... C23F 11/10

[52] U.S. Cl. ..... 252/389.4; 252/181; 252/389.54; 252/389.62; 252/180; 210/696; 210/698; 422/19

[58] Field of Search ..... 252/181, 389.54, 389.4, 252/389.62, 82, 180; 210/696, 698; 422/19

[56] References Cited

U.S. PATENT DOCUMENTS

| | | | |
|---|---|---|---|
| 4,176,059 | 11/1979 | Suzuki | 210/58 |
| 4,288,327 | 9/1981 | Godlewski et al. | 210/698 |
| 4,446,045 | 5/1984 | Snyder et al. | 252/180 |
| 4,512,552 | 4/1985 | Katayama et al. | 253/389 R |
| 4,714,564 | 12/1987 | Lynch et al. | 252/391 |
| 4,717,495 | 1/1988 | Hercamp et al. | 252/389.62 |
| 4,798,683 | 1/1989 | Boffardi et al. | 252/389 |
| 4,975,202 | 12/1990 | Fillipo et al. | 210/698 |

OTHER PUBLICATIONS

"Molydate Corrosion Inhibition in Deareated and Low-Oxygen Waters", *Corrosion*, Sep. 1986, vol. 42(9), by T. R. Weber et al.

"The Corrosion Inhibition of Metals by Molybdate Part 1. Mild Steel", *Corrosion-NACE*, May 1983, by M. A. Stranick.

"Effect of Surfactants Upon Corrosion Inhibition of High-Strength Steels and Aluminum Alloys", *Corrosion-NACE*, vol. 39, No. 7, Jul. 1983.

*Betz Handbook of Industrial Water Conditioning*, 8th ed., 1980, pp. 173-174.

*Primary Examiner*—Charles T. Jordan
*Assistant Examiner*—Valerie Fee
*Attorney, Agent, or Firm*—Alexander D. Ricci; Richard A. Paikoff

[57] ABSTRACT

A composition and method for controlling corrosion of steel in aqueous systems such as cooling and boiler systems. The combination of a nonionic surfactant and an anionic oxygen containing group such as one or more alkali metal salts of borate, molybdate and nitrate/nitrite provide improved corrosion inhibition of steel in aqueous systems. The magnetite layers formed in the presence of this combination exhibit decreased porosity and increased corrosion resistance to acidic solutions. This combination also inhibits entry of hydrogen into steel when exposed to acidic solutions thereby inhibiting hydrogen embrittlement. The preferred nonionic surfactant is phenol/polyethylene oxide nonionic surfactant and the preferred alkali metal salt is $Na_2MoO_4$.

4 Claims, 5 Drawing Sheets

ANODIC POLARIZATION OF MILD STEEL
0.1 M Na 2SO4 @ 22 deg C ph = 6.3

ANODIC POLARIZATION OF MILD STEEL
0.1 M Na 2SO4 @ 22 deg C pH = 6.3

COUPONS IN 100 ppm NaCl+400 ppm N2H4 SOLUTION @ T=286+-3 C
P=1000 psi

COUPONS IN 100 ppm NaCl + 400 ppm N2H4 SOLUTION @ T = 286+-3C
P = 1000 psi

CORROSION INHIBITORS FOR FERROUS METALS IN AQUEOUS SOLUTIONS COMPRISING A NONIONIC SURFACTANT AND AN ANIONIC OXYGEN CONTAINING GROUP

RELATED APPLICATION

This application is a continuation-in-part of Ser. No. 07/346,095, filed May 2, 1989, now abandoned.

FIELD OF THE INVENTION

The present invention relates to the inhibition of corrosion of steel in aqueous systems through the formation of a protective coating. More particularly, the present invention relates to the use of a phenol/ethylene oxide surfactant in combination with an alkali metal salt of borate, molybdate, or nitrate/nitrite to provide corrosion inhibition of steel in aqueous systems.

BACKGROUND OF THE INVENTION

Although the present invention has general applicability to any given aqueous system where corrosion of steel is a potential problem, the invention will be discussed in detail as it concerns cooling water and boiling water.

The term "cooling water" is applied whenever water is circulated through equipment to absorb and carry away heat. This definition includes air conditioning systems, engine jacket systems, refrigeration systems as well as the multitude of industrial heat exchange operations, such as found in oil refineries, chemical plants, steel mills, etc.

The use of recirculating systems in which a cooling tower, spray pond, evaporative condenser, and the like serve to dissipate heat permits great economy in makeup water requirements. With the increased awareness of the environmental affects of once-through water systems, increasing use is made of recirculating systems in which water is used over and over again.

For example, after passage of circulating cooling water through heat exchange equipment, the water is cooled when passed through a cooling tower. This cooling effect is produced by evaporation of a portion of the circulating water in passing through the cooling tower. By virtue of the evaporation which takes place in cooling, the dissolved solids and the suspended solids in the water become concentrated.

The circulating water becomes more concentrated than the makeup water due to this evaporation loss. Cycles of concentration is the term employed to indicate the degree of concentration of the circulating water as compared with the makeup water. For example, two cycles of concentration indicates the circulating water has twice the concentration of ions as the makeup water. The use of oxidizers which promote passivation, such as chromate, nitrite, molybdate and tungstate is known in both once through and recirculating cooling water systems. See Betz Handbook of Industrial Water Conditioning, 1980, pages 173–174.

As described comprehensively in U.S. Pat. No. 4,288,327, the deposition of solids onto heat transfer surfaces of steam generating equipment is a major problem. Common contaminants in boiler feedwater that can form deposits are calcium and magnesium salts (hardness), carbonate salts, sulfite, phosphate, siliceous matter, and iron oxides. Any foreign matter introduced into a boiler in soluble or particulate form will tend to form deposits on the heat transfer surfaces. Formation of deposits on the transfer surfaces takes place and can lead to overheating, circulation restrictions, damage to the system, loss of effectiveness and increased cost due to cleaning, unscheduled outages and replacement of equipment. Also, such deposits can aggravate corrosion of the underlying metal.

Deposits in lines, heat exchange equipment etc., may originate from several causes. For example, the precipitation of calcium salts will form scale. In addition, solid foulant particles may enter the system and through collision with neighboring solid particles, these foulants may agglomerate to a point where they either foul the heat transfer surfaces or begin to accumulate in low flow areas of the system. On the other hand, corrosion may occur. Corrosion is the electrochemical reaction of metal with its environment. It is a destructive reaction and, simply stated, is the reversion of refined metals to their natural state. Also, concomitant with the corrosion process, hydrogen attack or embrittlement can occur where hydrogen permeates the metal structure, reacting with iron carbide to form methane which results in rupture along the crystalline boundaries.

In the past, in order to minimize the formation of scale forming salts, cooling water systems were operated at pH's where the solubility of the "hardness" or "scale forming" ions was the greatest. Because the pH's of the systems were acidic, corrosion inhibitors together with dispersants were the normal treatment. These materials interacted with the metal to directly produce a film which was resistant to corrosion, or to indirectly promote formation of protective films by activating the metal surface so as to form a stable oxide or other insoluble salt. However, such protective films are not completely stable, but rather constantly degrading under the influences of the aggressive conditions in the water. Because of this, a constant supply of corrosion inhibiting substances, sufficient for the, purpose, must be maintained in the water.

Similarly, the formation of scale and sludge deposits on boiler heating surfaces is a serious problem encountered in steam generation. Although current industrial steam producing systems make use of sophisticated external treatment of the boiler feedwater, e.g. coagulation, filtration, softening of water prior to its feed into the boiler system, these operations are only moderately effective. In all cases, external treatment does not in itself provide adequate treatment since muds, sludge, silts and hardness imparting ions can escape the treatment and eventually are introduced into the steam generating system. Accordingly, internal treatments have been necessary to maintain the mud and silts in a suspended state. These internal treatments have been referred to in the industry as sludge conditioning agents.

In addition to the problems caused by mud, sludge, or silts, the industry has also had to contend with scale in boiler and cooling water. Although external treatment is utilized specifically in an attempt to remove calcium and magnesium from the feedwater, scale formation due to residual hardness, i.e., calcium and magnesium salts, is always experienced. Accordingly, internal treatment, i.e., treatment of the water fed to the system, is necessary to prevent, reduce, and or retard formation of scale imparting compounds and their deposition. As in cooling water, pH is employed to control deposition and also corrosion in boiler systems.

Many and different types of materials have been used in the treatment of water systems. For example, corrosion in a boiler condensate system may be treated by mechanical deaeration of the feedwater and chemical oxygen scavenging. Neutralizing and filming amines are also commonly employed in boiler water condensate systems to control corrosion. In open recirculating cooling water systems, corrosion control is primarily achieved by additives which retard destruction of metals by chemical or electrochemical reactions. For example, combinations of chromate, polyphosphate, and zinc are well known cooling system corrosion inhibitors. U.S. Pat. No. 4,446,045 discusses a number of deposition and scale control materials used for the treatment of water systems.

SUMMARY OF THE INVENTION

The present invention is directed to an improved method and composition for controlling corrosion of mild steel in aqueous systems. The present inventor has discovered that the addition of a nonionic surfactant such as a phenol/polyethylene oxide added in conjunction with an anionic oxygen containing moiety such as an alkali metal salt of nitrate/nitrite, molybdate or borate provides improved corrosion inhibition of steel in aqueous systems. It has also been discovered that magnetite layers formed on steel at high pressure in an aqueous solution containing a phenol/polyethylene oxide nonionic surfactant in combination with an alkali metal salt of nitrate/nitrite, molybdate or borate exhibit a lowered porosity and increased corrosion resistance to acidic solutions. It has also been discovered that this combination inhibits the entry of hydrogen into steel immersed in acidic solutions thereby inhibiting hydrogen embrittlement of the steel. While the preferred anionic component is an alkali metal salt of nitrate/nitrite, molybdate or borate, it is believed most anionic species containing oxygen would be effective.

DETAILED DESCRIPTION OF INVENTION

Figure 1:
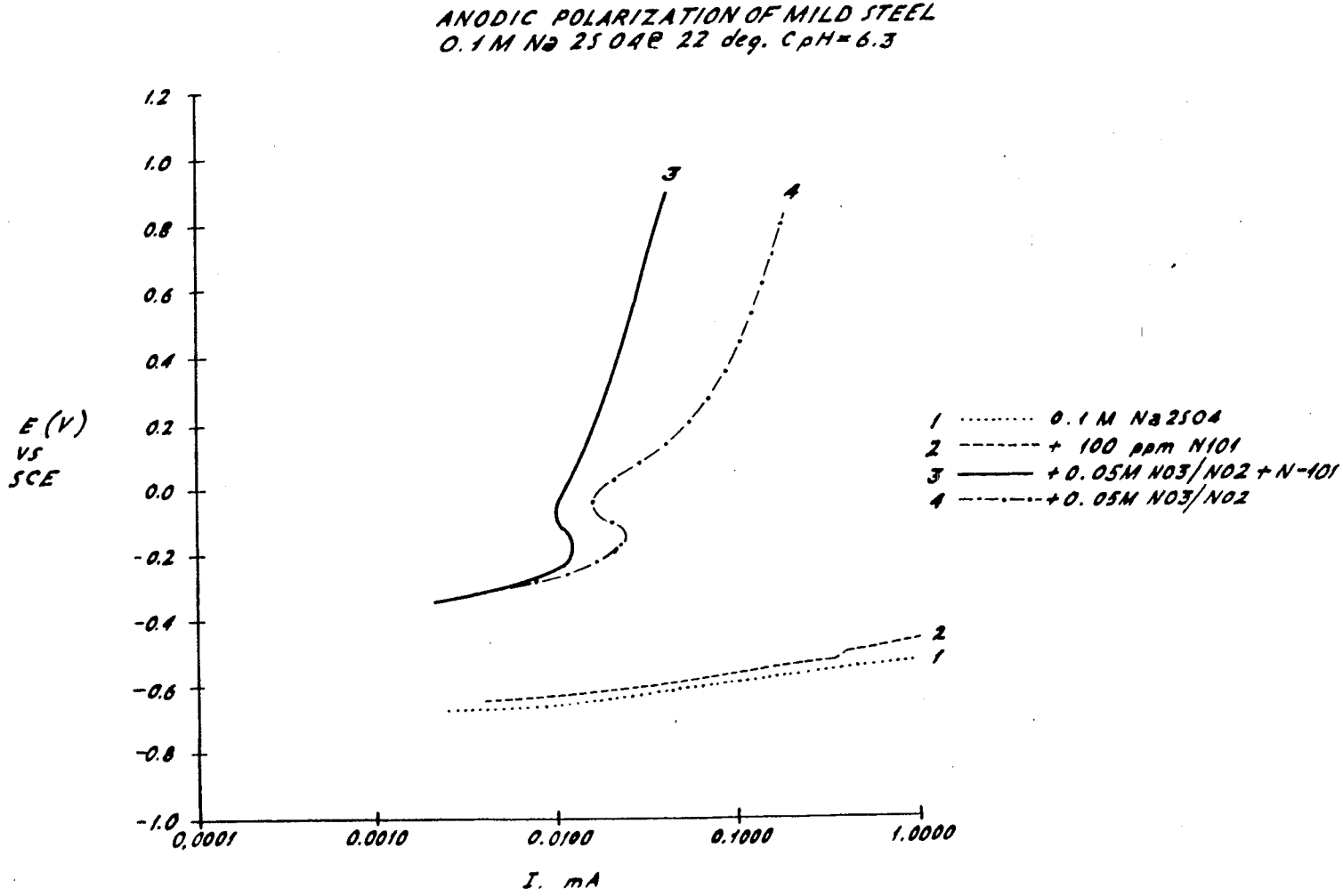
In FIG. 1, plots of measured anodic current verses applied potential (anodic polarization curves) for mild steel electrodes in 0.1M $Na_2SO_4$ are displayed, with $NaNO_3/NaNO_2$ and/or Rohm and Haas Triton N-101 (N-101) added.

In accordance with the present invention, a method and composition for inhibiting corrosion of steel in aqueous solutions is provided. The present inventor has discovered that the addition of a phenol/polyethylene oxide nonionic surfactant in combination with an anionic oxygen containing moiety such as an alkali metal salt of nitrate/nitrite, borate or molybdate provides improved corrosion protection for steel in aqueous solutions. The enhanced effectiveness of the nitrate/nitrite, borate, molybdate systems provided by the concerted use of a nonionic surfactant provides effective corrosion protection at lower bulk water concentrations of inhibitor. This reduces the level of chemicals discharged from the system. It is also believed that the increased effectiveness of the present invention could provide corrosion protection under severe conditions such as under severe upset, at high or low pH, high solids etc. which would normally not be adequately protected.

The nonionic surfactants employed in accordance with the present invention are those which provide improved corrosion inhibition when employed in combination with the anions described below. The broad class, nonionic surfactants, is well known. A listing of nonionic surfactants can be found in "McCutcheon's Emulsifiers and Detergents", 1987 N. American Edition, McCutcheon division, MC Publishing Co., Glen Rock, NJ. The Hwa patent, U.S. Pat. No. 3,578,589 also contains an extensive list of nonionic surfactants, herein incorporated by reference.

The preferred surfactants of the present invention have the following structure:

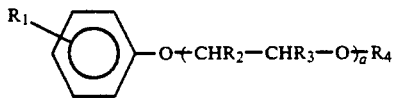

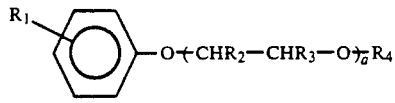

wherein $R_1$ is a straight or branched alkyl group having from about 4 to about 20 carbon atoms; $R_2$ and $R_3$ are independently hydrogen or methyl; $R_4$ is hydrogen, alkyl, aryl or aralkyl, the alkyl portion of said aralkyl group being a straight or branched chain having from about 1 to about 20 carbon atoms, and the aryl portion of aralkyl group being substituted benzene or naphalene; and a is from about 0 to about 50. Most preferred for the present invention are commercial materials such as the homologous series of alkoxylated octyl or nonyl phenols, sold by Rohm and Haas under the Triton label. Typical of the preferred surfactants are the Triton N-series, which are nonyl phenols containing from about 4 moles of ethylene and/or propylene oxide up to about 30 moles of ethylene and/or propylene oxide. Most preferred is nonyl phenol reacted with 10 moles of ethylene oxide represented by Rohm and Haas Triton N-101.

The alkali earth metal salts of nitrate/nitrite, borate and molybdate useful in combination with the nonionic surfactants are commonly employed in boiler water treatment. Preferred are the sodium salts i.e., $NaNO_2/NaNO_3$, $Na_2B_4O_7$ or $Na_2MoO_4$. The most preferred alkali metal salt is $Na_2MoO_4$ which has been found to promote the formation of a low porosity, highly corrosion resistant magnetite layer on steel under high pressure conditions in an aqueous solution also containing a nonionic surfactant such as Triton N-101.

The mechanism by which the nonionic surfactant increases the corrosion inhibition is not yet fully understood. The inhibition action of the anions is known to be the result of their adsorption at the metal/solution interface. It is believed that the co-adsorption of the nonionic surfactant may increase the maximum surface concentration of the anion or serve to "poison" sites of specific adsorption. The anionic species are adsorbed at the metal surface and incorporated into the forming oxide layer . The anionic species is believed to effectively dope the oxide layer causing a change in crystal structure, morphology and solubility of the oxide layer. It has been found that the effects on the oxide properties are a function of the specific anion species. For example, $PO_4^{3-}$ was found to be detrimental to oxide crystallinity, morphology and solubility while $MoO_4^{2-}$ imparted beneficial effects to the formed oxides.

It is believed that co-adsorption of the nonionic surfactant with the anionic species allows a higher surface concentration of anions. The surface concentration of anions can be limited by the hydrostatic repulsive forces which act between anions. A nonionic surfactant acts to "shield" anions thus allowing a closer approach distance. The adsorption of these surfactants occurs at localized sites of high chemical potential such as dislocations or grain boundaries thereby promoting the formation of a more uniform crystalline structure. Additionally, the adsorption of the surfactant and anions alters the surface sites such as grain boundaries and imperfections in the microstructure where atomic hydrogen may be trapped and enter the steel, effectively blocking entry at the site.

The method of the present invention when employed as an internal boiler treatment comprises adding to the feedwater an oxide "dopant" or blend of dopants, i.e., anionic corrosion inhibitors combined with a nonionic surface active species. The adsorption of this combination during formation of an oxide layer in the system will provide uniformly formed oxide layers which are less porous, mechanically stronger and less soluble than undoped oxides. Because oxide formation in high temperature aqueous systems is a continuous, dynamic process the combination of the present invention is preferably fed continuously. The present invention provides a treatment which is superior to and easier to achieve than the prior method of minimizing the dissolution of native oxides through control of bulk water chemistry such as pH as a function of temperature.

It is believed that typical treatment levels for boiler and cooling water for the present invention can range from about 2.1 to about 1000 parts treatment to million parts system water. Preferred treatment levels for boiler and cooling water range from about 1 to about 50 parts per million.

The invention is further illustrated by the following specific examples and tables which should not be construed as limiting the invention as defined in the claims.

EXAMPLES

The corrosion inhibition action of the anion/surfactant combination of the present invention was demonstrated using anodic polarization measurements performed using polished electrodes of 1010 mild steel immersed in 0.1 molar $NaSO_4$ (pH 6.2, 22° C.). The solutions were deaerated by sparging with high purity nitrogen gas prior to use. A standard 3 electrode cell and saturated calomel reference and glassy carbon counter electrode were employed. A PAR potentiostat/galvanostat was used for all current-voltage measurements FIGS. 1, 2 and 3 are plots of measured anodic current versus applied potential summarizing the results of the anodic polarization experiments.

FIG. 1 summarizes data with respect to the anodic polarization effects of Triton N-101, nitrate/nitrite, and the combination of N-101 and nitrate/nitrite. Curve 1 represents the corrosion effect of the solution absent any treatment. Curve 2 shows that the addition of 100 ppm N-101 has little or no effect on corrosion. Curve 4 indicates the anticorrosive effect of nitrate/nitrite by its shift in corrosion potential in the anodic direction and lowered measured current. Curve 3 shows the further improvement when the nitrate/nitrite is combined with the nonionic surfactant Triton N-101.

Figure 2:
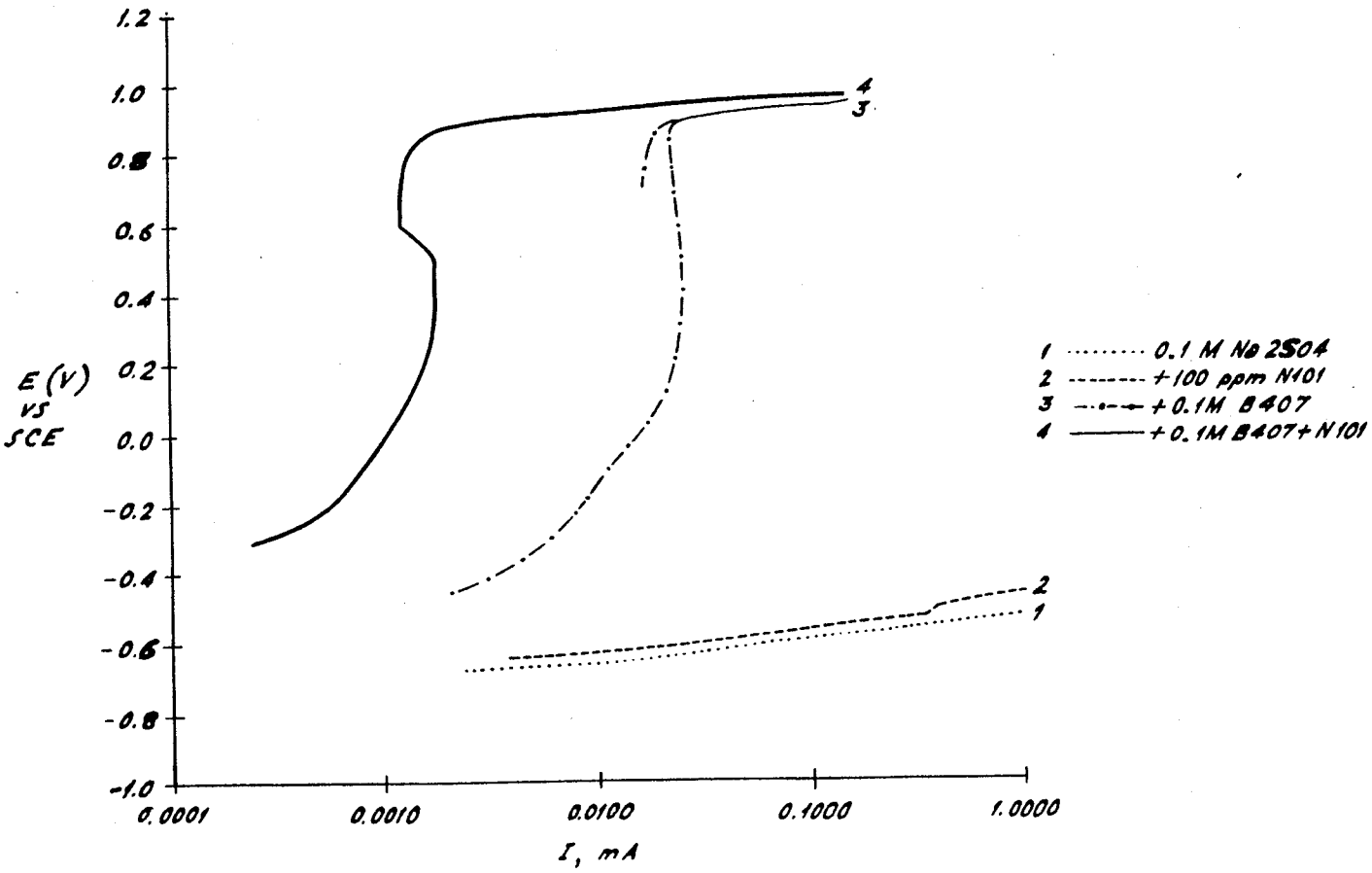
In FIG. 2, anodic polarization curves for mild steel electrodes in 0.1M $Na_2SO_4$ are shown, with $Na_2B_4O_7$ and/or N-101 added.

FIG. 2 summarizes the data with respect to the anodic polarization effect of Triton N-101, borate and the combination of N-101 and borate. Curve 1 represents the corrosive effect of the solution absent any treatment. Curve 2 shows that the addition of 100 parts per million N-101 has little or no effect on corrosion. Curve 3 indicates the anticorrosive effect of borate by its shift in corrosion potential in the anodic direction and lowered measured current. Curve 4 shows the further improvement when borate is combined with the anionic surfactant Triton N-101.

Figure 3:
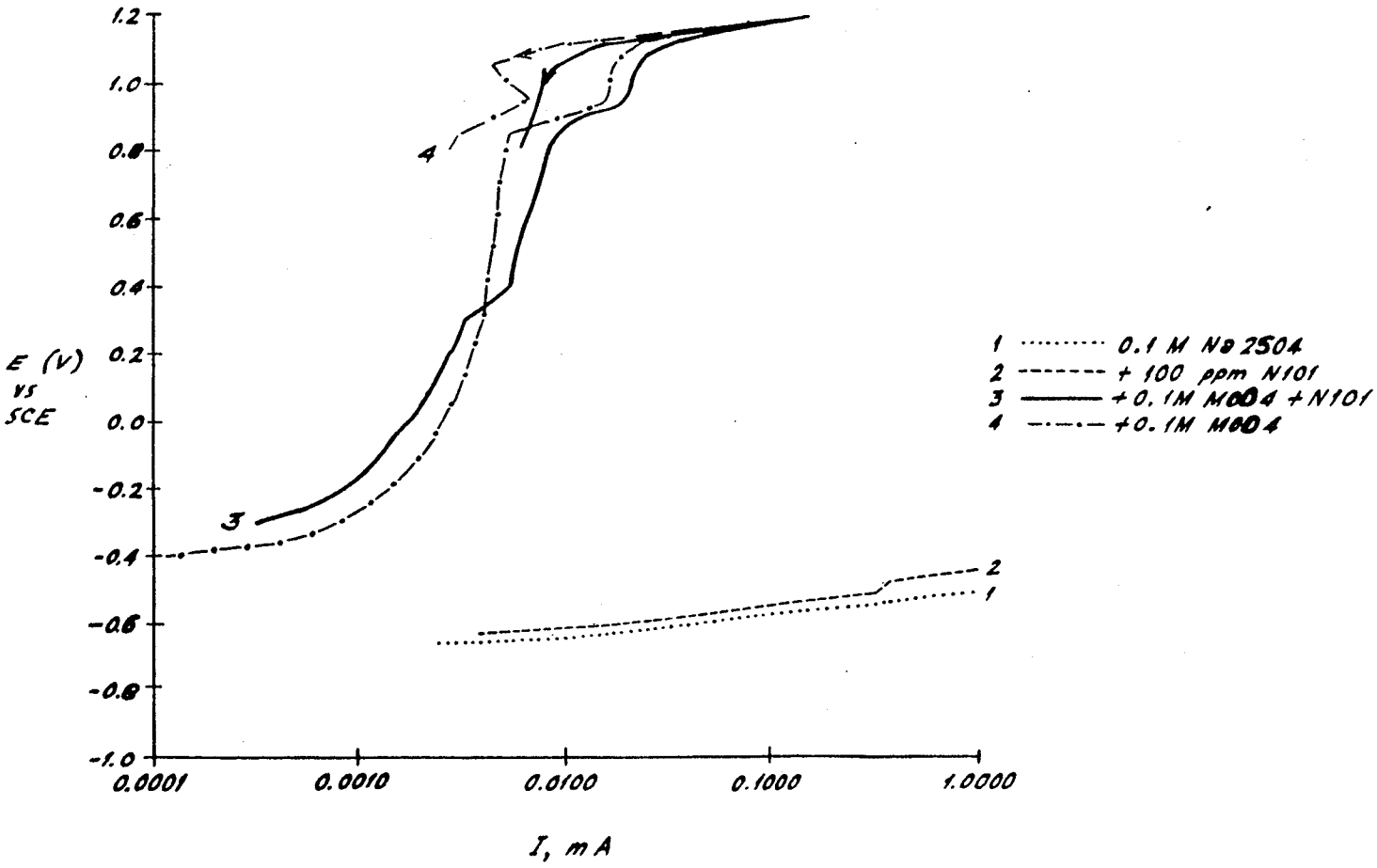
In FIG. 3, similar anodic polarization curves for mild steel electrodes in 0.1M $Na_2SO_4$ are displayed, with $Na_2MoO_4$ and/or N-101 added.

FIG. 3 summarizes data with respect to the anodic polarization effects of Triton N-101, molybdate and the combination of N-101 and molybdate. Curve 1 represents the corrosive effect of the solution absent any treatment. Curve 2 shows that the addition of 100 parts per million N-101 has little or no effect on corrosion. Curve 4 indicates the anticorrosive effect of molybdate by its shift in corrosion potential in the anodic direction and lowered measured current. Curve 3 shows the improvement when molybdate is combined with the anionic surfactant Triton N-101.

Further characterization of the anticorrosive effect of $Na_2MoO_4$ was undertaken by investigating the porosity and inhibition of atomic hydrogen entry into magnetite layers formed on 1010 mild steel at high pressures in aqueous solutions containing Triton N-101 and $Na_2MoO_4$.

The magnetite layers were formed by cleaning standard SAE (AISI) 1010 low carbon steel coupons. The coupons were cleaned with a tap water slurry of pumice and $Na_3PO_4$ powder, rinsed with demineralized water and dried in a vacuum desiccator. The magnetite layers were formed by exposing the cleaned coupons to high temperature aqueous solutions in a pressurizing autoclave. The aqueous solutions included 10 parts per million NaCl, 400 parts per million hydrazine and were adjusted to pH 10.0 with NaOH or $H_2SO_4$. As required, 100 parts per million $Na_2MoO_4$ and or 40 parts per million Triton N-101 was added. The coupons were exposed for 96 hours. After treatment by this procedure the coupons exhibited a tightly adherent, uniform black film. The porosity of the magnetite layer formed was then estimated by dipping the coupons, for a measured time (corrosion time, Tc) in a corrosive solution containing the following: 10 ml 0.1 molar KI, 10 ml 0.01 molar $NaS_2O_3$, 10 mls 0.2% starch indicator solution, 25 ml 0.1 molar $KNO_3$ and 25 ml 0.25 molar HCl.

Figure 4:
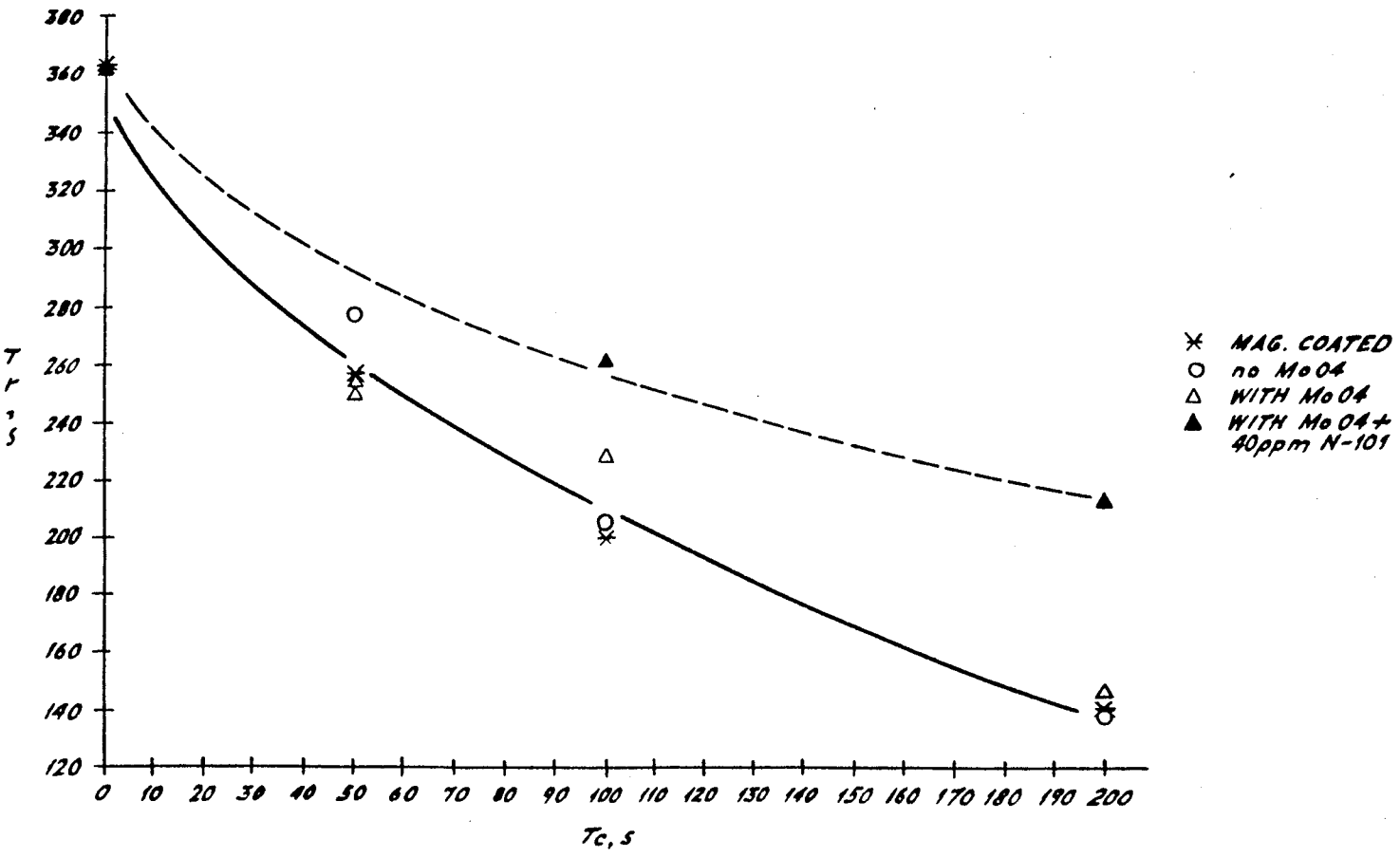
FIGS. 4 and 5 are plots of Tr (reaction time) to Tc (corrosion time) for oxide coated coupons.
Figure 5:
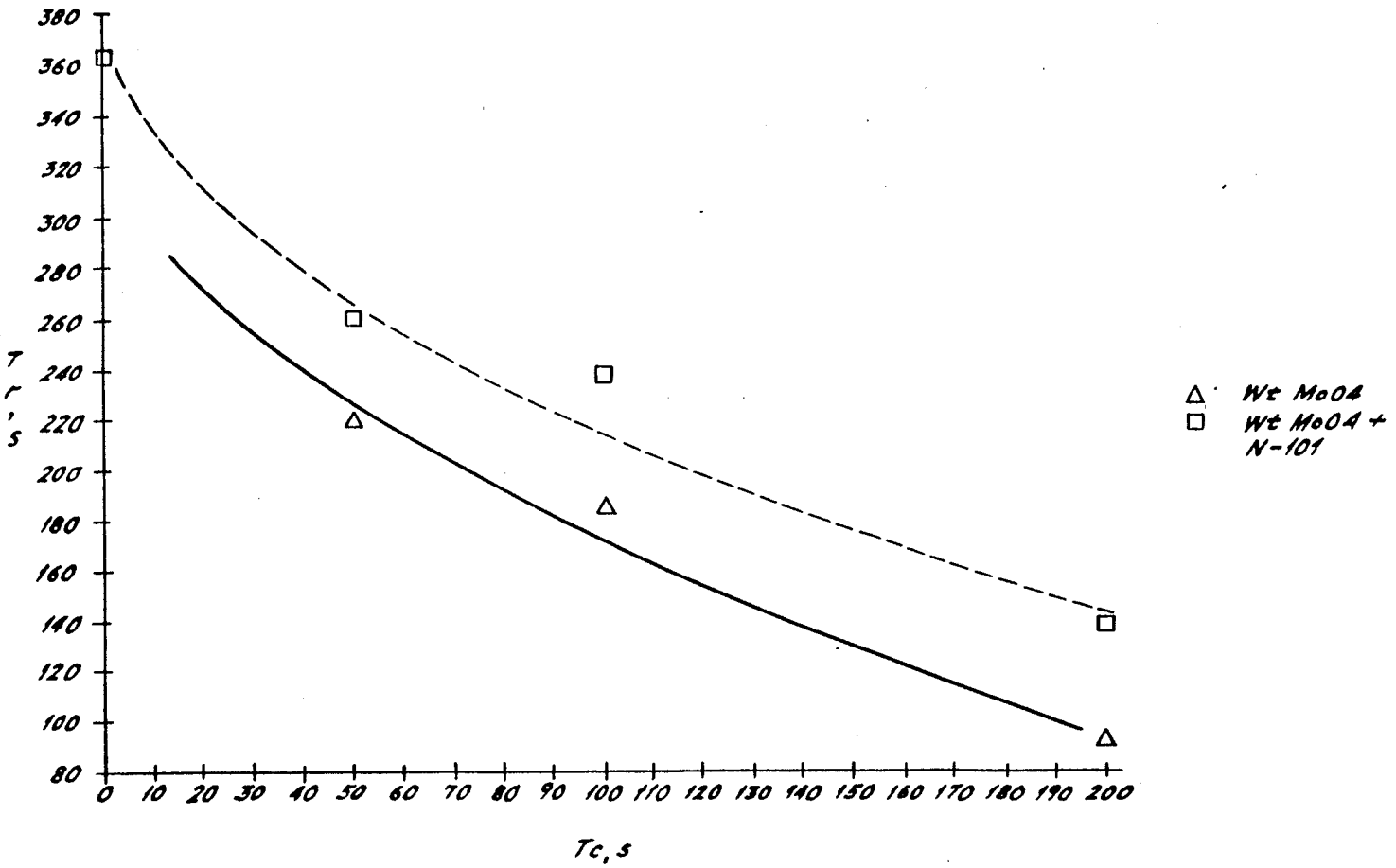

Mild steel, but not magnetite is readily corroded in this solution. After the test coupons were removed from the corroding solution, 20 ml of 0.4 molar $Na_2S_2O_8$ was added and the time to color change was recorded ($T_r$). $T_r$ is inversely proportional to the Fe(II) concentration and therefore related to porosity (i.e., exposure of the underlying steel) of the magnetite coatings. FIGS. 4 and 5 are plots of $T_r$ vs. $T_c$ for treated coupons. As can be seen, the reaction times, $T_r$, are significantly longer for magnetite layers formed in the presence of both $Na_2MoO_4$ and Triton N-101 than for those grown in either the standard solution or with $Na_2MoO_4$ alone. This increase in $T_r$ indicates that the oxide coating is denser, less porous and exposes a lower surface area of the substrate to the corroding solution.

The inhibition of passage of atomic hydrogen into mild steel was estimated by measuring hydrogen permeation through mild steel foil electrodes exposed to an acidic solution. All measurements were performed at 22° C. using 1010 mild steel electrodes polished with 600 grid emery paper. A 30 nm palladium layer was vapor deposited on one side of the electrode. The palladium layer serves to catalyze the oxidation of atomic hydrogen in order to facilitate measurement of hydrogen permeation rates. The electrode was placed in a two compartment glass cell with one surface exposed to 0.5 molar $H_2SO_4$, with 0.05 molar KI added as an atomic hydrogen promoter (cathode or hydrogen generation side). The opposite palladium coated surface was exposed to 0.1 molar NaOH (anode or atômic hydrogen detection side). The cathode side was then polarized with −2.5 volts DC to generate hydrogen. The anode side was polarized at +0.4 volts versus a saturated calomel electrode and the current measured. The anodic current detected is due to oxidation of atomic hydrogen which is diffusing through the mild steel foil, and is referred to as the hydrogen permeation current ($I_{hp}$). The effect of nitrate/nitrite, borate, molybdate and Triton N-101 to inhibit the entry of hydrogen into the electrode was determined by adding each to the cathode side solution, measuring the $I_{hp}$ and comparing it to the standard $I_{hp}$ for the solution.

The effect of the additives on hydrogen permeation currents is summarized in Table 1. Based upon the reduction of $I_{hp}$, it can be seen that the combination of a nonionic surfactant and an anionic species inhibits hydrogen permeation and thus inhibits hydrogen embrittlement which can result in failure of the steel due to cracking or other action.

TABLE 1

| | Hydrogen Permeation Currents KI Added as Promoter | | |
|---|---|---|---|
| KI mol/L | Add. 1 | Add. 2 | $I_{hp}$ uA |
| 0.025 | | | 130.00 |
| 0.050 | | | 165.00 |
| 0.050 | | 10 ppm N-101 | 7.50 |
| 0.050 | | 20 ppm N-101 | 15.00 |
| 0.050 | | 100 ppm N-101 | 9.00 |
| 0.050 | .05M $K_2B_4O_7.H_2$ | | 116.75 |
| 0.050 | .05M $K_2B_4O_7.H_2$ | 100 ppm N-101 | 4.50 |
| 0.010 | .05M $K_2B_4O_7.H_2$ | 100 ppm PMA | 44.00 |
| 0.025 | .05M $KNO_3$ | | 71.50 |
| 0.025 | .05M $KNO_3$ | | 67.50 |
| 0.050 | .05M $KNO_3$ | | 49.00 |
| 0.025 | .05M $Na_2MoO_4.2H_2O$ | | 74.50 |
| 0.050 | .05M $Na_2MoO_4.2H_2O$ | | 12.50 |
| 0.050 | .05M $Na_2MoO_4.2H_2O$ | 10 ppm N-101 | 14.75 |
| 0.050 | .05M $Na_2PO_4.2H_2O$ | | 82.50 |

In addition to the measurements described above, the present invention was also tested in a simulated cooling water environment. A cooling water environment was simulated by exposing low carbon steel metal test coupons to a moving aqueous solution at a temperature of about 120° F. The aqueous solution included: 70 parts per million (ppm) $Ca^{++}$ as $CaCO_3$, 33 ppm $Mg^{++}$ as $CaCO_3$, 100 ppm $Cl^-$ ions, 100 ppm $SO_4^{--}$ ions, and 100 ppm $HCO_3^-$ ions. The results are summarized in Tables 2 and 3. In Table 2, the effects on corrosion rate for borates, molybdates, and nitrate/nitrite both alone and in combination with N-101 surfactant are summarized. CoorShield 736 employed in runs 5 and 6 of Table 2 is a molybdate base corrosion control agent currently available from Betz Labs Inc., Trevose, PA. In Table 3, the effects on corrosion rate of borate and nitrate/nitrite in combination with different treatment levels of N-101 surfactant at varying pH is summarized. In the testing summarized in Table 3, initial pH was adjusted by the addition of dilute $H_2SO_4$, except for testing of borates at pH 7.0 where concentrated $H_2SO_4$ was employed. All runs in Table 3 also include 1 ppm of Dequest 2010 (hydroxyethylidene-1,1-diphosphonic acid) to control $CaCO_3$ deposition. In addition to the corrosion rate (in mils per year), the appearance of the test coupons was observed. Treatments which included the use of phenol/ethylene oxide surfactant in combination with an alkali metal salt of borate, molybdate, or nitrate/nitrite provided improved appearance i.e., a decrease in observable evidence of corrosion.

TABLE 2

| | Corrosion Rate in Simulated Cooling Water | | | | |
|---|---|---|---|---|---|
| | | | pH | | Corrosion Rate |
| Run | Additive | (ppm) | Initial | Final | (mpy) |
| 1 | $Na_2B_4O_7.5H_2O$ (800 ppm $B_4O_7$) | 1500 | 9.0 | 9.0 | 67 |
| 2 | $Na_2B_4O_7.5H_2O$ | 1500 | 9.0 | 9.0 | 57 |
| | plus N-101 | 50 | | | |
| 3 | $NO_2$ | 80 | 8.32 | 8.5 | 51 |
| | $NO_3$ | 80 | | | |
| 4 | $NO_2$ | 80 | 8.32 | 8.5 | 39 |
| | $NO_3$ | 80 | | | |
| | plus N-101 | 50 | | | |
| 5 | CorrShield 736 | 800 | 8.64 | 8.6 | 1.1 |
| 6 | CorrShield 736 | 800 | 8.63 | 8.6 | 1.1 |
| | plus N-101 | 50 | | | |

TABLE 3

| | Corrosion Rate in Simulated Cooling Water, pH 7.0 and 8.5 | | | |
|---|---|---|---|---|
| Run | Additive | (ppm) | pH | Corrosion Rate (mpY) |
| 1 | $NO_2$ | 150 | 7.0 | 18.4 |
| | $NO_3$ | 150 | | |
| | N-101 | 50 | | |
| 2 | $NO_2$ | 150 | 7.0 | 10.7 |
| | $NO_3$ | 150 | | |
| | N-101 | 75 | | |
| 3 | $NO_2$ | 150 | | |
| | $NO_3$ | 150 | 8.5 | 2.0 |
| | N-101 | 50 | | |
| 4 | $NO_2$ | 150 | | |
| | $NO_3$ | 150 | 8.5 | 2.6 |
| | N-101 | 75 | | |
| 5 | $B_4O_7$ | 2000 | 7.0 | 49.7 |
| | N-101 | 20 | | |
| 6 | $B_4O_7$ | 2000 | 7.0 | 38.6 |
| | N-101 | 100 | | |
| 7 | $B_4O_7$ | 2000 | 8.5 | 93.6 |
| | N-101 | 20 | | |
| 8 | $B_4O_7$ | 2000 | 8.5 | 85.3 |
| | N-101 | 100 | | |

As can be seen from FIGS. 1 through 5 and Table 1, 2 and 3 an increase in corrosion resistance and a decrease in hydrogen permeability can be effected when both a nonionic surfactant and an anionic species are fed to an aqueous system which contacts steel.

Other combinations of corrosion inhibitors and surfactants were tested in order to characterize the impact of specific anionic and cationic surfactants on the corrosion inhibition action of borates and nitrite/nitrate salts. Calculated values of corrosion potential (Ecorr) corrosion current (Icorr) are listed in Tables 4–8.

It was found that only specific combinations of corrosion inhibitors and surfactants exhibit synergistic corrosion inhibition effects. Poly(methacrylic acid) (anionic), Zonyl FSC (cationic) and hydroxyethyldiphosphonic acid (anionic) have no impact on the effectiveness of borate and nitrate/nitrite salts to inhibit the corrosion of mild steel. In addition, Zonyl FSC adversely impacts the corrosion inhibition of borate salts, but has no impact on nitrate/nitrite salts. None of the surfactants tested by themselves exhibit significant effectiveness in inhibiting the corrosion of mild steel.

Furthermore, it was discovered that Triton QS-44 by itself increases the corrosion inhibition effectiveness of borate and nitrate/nitrite salts. It is believed this may be due to the occurrence of a simple filming rather than a specific interaction with the mild steel surface.

TABLE 4

1010 Mild Steel in 0.1M $Na_2SO_4$
No Inhibitors added
Surfactants added sequentially

| | Additive | Ecorr mV vs SCE | Icorr uA/cm$^2$ |
|---|---|---|---|
| 1. | Blank | −760 | 3.52 |
| 2. | 100 ppm Zonyl FSC | −707 | 3.56 |
| 3. | 100 ppm Poly(methacrylic acid) (PMA) | −720 | 2.71 |
| 4. | 100 ppm Triton QS-44 | −613 | 3.21 |

TABLE 5

1010 Mild Steel in 0.1M $Na_2SO_4$
0.1M $K_2B_4O_7$ added
Surfactants added individually

| | Additive | Ecorr mV vs SCE | Icorr uA/cm$^2$ |
|---|---|---|---|
| 1. | Blank | −374 | 0.20 |
| 2. | 100 ppm Zonyl FSC | −457 | 0.70 |
| 3. | 100 ppm Poly(methacrylic acid) (PMA) | −440 | — |
| 4 | 100 ppm Triton QS-44 | −314 | 0.16 |

TABLE 6

1010 Mild Steel in 0.1M $Na_2SO_4$
0.1M $Na_2B_4O_4$ added
Surfactants added individually

| | Additive | Ecorr mV vs SCE | Icorr uA/cm$^2$ |
|---|---|---|---|
| 1. | Blank | −449 | 0.38 |
| 2. | 100 ppm Poly(methacrylic acid) (PMA) | −440 | — |

TABLE 7a

1010 Mild Steel in 0.1M $Na_2SO_4$
0.1M $NaNO_2$ + 0.1M $NaNO_3$ added
Surfactants added sequentially

| | Additive | Ecorr mV vs SCE | Icorr uA/cm$^2$ |
|---|---|---|---|
| 1. | 0.1M $NaNO_3$ only | −714 | 6.5 |
| 2. | Blank (0.1M $NaNO_2$ + 0.1M $NaNO_3$) | −403 | 0.71 |
| 3. | 100 ppm Zonyl FSC | −380 | 0.61 |
| 4. | 100 ppm Triton QS-44 | −269 | 0.30 |

TABLE 7b

1010 Mild Steel in 0.1M $Na_2SO_4$
0.1M $NaNO_2$ + 0.1M $NaNO_3$ added
Surfactants added sequentially

| | Additive | Ecorr mV vs SCE | Icorr uA/cm$^2$ |
|---|---|---|---|
| 1. | Blank (0.1M $NaNO_2$ + 0.1M $NaNO_3$) | −403 | 0.71 |
| 2. | 100 ppm Poly(methacrylic acid) (PMA) | −449 | — |
| 3. | 100 ppm Hydroxyethyldiphosphonic acid (HEDP) | −474 | 23 |
| 4. | 100 ppm Triton N-101 | −487 | 25 |

TABLE 8

Ecorr and Rp for 1010 Mild Steel Electrodes
0.1M $Na_2SO_4$, pH 6, 22 deg C., E versus SCE

| Additive 1 | Additive 2 | Ecorr V vs SCE | Rp kohm-cm$^2$ |
|---|---|---|---|
| — | — | −0.68 | 3.15 |
| — | — | −0.65 | 3.62 |
| 0.05M $NaNO_2$ 0.05M $NaNO_3$ | — | −0.355 | 13.7 |
| 0.05M $NaNO_2$ 0.05M $NaNO_3$ | 100 ppm N-101 | −0.387 | 40.5 |
| 0.1M $Na_2MoO_4$ | — | −0.425 | 12.9 |
| 0.1M $Na_2MoO_4$ | 100 ppm N-101 | −0.350 | 119 |
| 0.1M $Na_2B_4O_7$ | — | −0.500 | 53 |
| 0.1M $Na_2B_4O_7$ | 100 ppm N-101 | −0.360 | 98 (+/−24) |

While this invention has been described with respect to particular embodiments thereof, it is apparent that numerous other forms and modifications of this invention will be obvious to those skilled in the art. The appended claims in this invention generally should be construed to cover all such obvious forms and modifications which are within the true spirit and scope of the present invention.

What is claimed is:

1. A method of inhibiting the corrosion of ferrous metals in an open circulating cooling or boiler water aqueous system comprising adding to the aqueous system a composition comprising;

(i) a phenol/polyethylene nonionic surfactant; and (ii) one or more alkali metal salts of borate, molybdate, and nitrate/nitrite.

2. The method of claim 1 wherein said nonionic surfactant has the following structure:

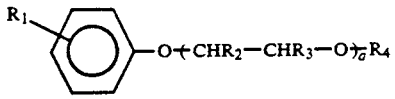

wherein $R_1$ is a straight or branched alkyl group having from about 4 to about 20 carbon atoms; $R_2$ and $R_3$ are independently hydrogen or methyl; $R_4$ is hydrogen, alkyl, aryl, or aralkyl, the alkyl portion of the aralkyl group being straight or branched chain having from about 1 to about 20 carbon atoms, and the aryl portion being substituted benzene or naphthalene; and a is from 0 to about 50.

3. The method of claim 2 wherein $R_1$ is nonyl, $R_2$, $R_3$, and $R_4$ are hydrogen and a is about 4 to about 50.

4. The method of claim 2 wherein $R_1$ is t-octyl, $R_2$, $R_3$, and $R_4$ are hydrogen and a is about 4 to about 50.

* * * * *